United States Patent [19]

Parma et al.

[11] Patent Number: 4,527,739

[45] Date of Patent: Jul. 9, 1985

[54] FLOOR CLEANING APPARATUS

[75] Inventors: Giovanni Parma, Desio; Francesco Bartolomucci, San Donato Milanese, both of Italy

[73] Assignees: Fiat Auto S.p.A.; Midis S.a.s. di Francesco Bartolomucci, both of Italy

[21] Appl. No.: 435,802

[22] Filed: Oct. 21, 1982

[30] Foreign Application Priority Data

Oct. 27, 1981 [IT] Italy ..... 53747/81[U]

[51] Int. Cl.[3] ..... B05B 3/18

[52] U.S. Cl. ..... 239/186; 15/312 R; 15/320; 134/172; 239/161; 239/163; 239/199

[58] Field of Search ..... 239/178, 184, 186, 187, 239/188, 199, 251, 262, 287, 252, 256, 161, 163; 134/172, 198; 15/312 R, 320

[56] References Cited

U.S. PATENT DOCUMENTS

| | | | |
|---|---|---|---|
| 3,832,069 | 8/1974 | Petsch | 239/251 X |
| 3,880,430 | 8/1974 | Hartunian | 239/186 |
| 3,942,215 | 3/1976 | Olds | 15/320 |
| 4,158,443 | 6/1979 | Kameda et al. | 239/186 X |
| 4,191,589 | 3/1980 | Halls et al. | 239/251 X |
| 4,271,617 | 6/1981 | Yoshizawa | 239/287 X |
| 4,346,843 | 8/1982 | Long et al. | 239/199 |

*Primary Examiner*—Jeffrey V. Nase

*Attorney, Agent, or Firm*—Sughrue, Mion, Zinn, Macpeak, and Seas

[57] ABSTRACT

Apparatus is provided for cleaning horizontal surfaces, such as the grated flooring of paint workshops, by hydrodynamic action. The apparatus includes a carriage which can be moved back and forth over the surface to be cleaned, and a winding drum which is carried by the carriage and is arranged to pay out and wind in a high-pressure water supply hose as the carriage moves back and forth. The hose feeds water under pressure to nozzles carried at the ends of rotary arms mounted at the front and to both sides of the carriage. Water under pressure is also supplied to nozzles provided on two transverse arms of the carriage. These latter arms are angularly orientable about their longitudinal axes.

6 Claims, 3 Drawing Figures

FLOOR CLEANING APPARATUS

The present invention relates to apparatus for cleaning horizontal surfaces, particularly grated flooring of painting chambers, by hydrodynamic action.

The subject of the present invention is intended to provide apparatus of the type specified above which allows the rationalisation of the trajectories of the water jets so as to use the energy available in the jets for the least possible time and over as large a possible surface.

A further object of the invention is to provide apparatus in which the arrangement and the drive for the water jets are such as to allow it to operate very close to the surfaces to be treated and with an entirely automatic action.

The apparatus which is the subject of the invention is characterised essentially by the fact that it comprises a motorised carriage which can be moved back and forth along the surface to be cleaned and carries a winding drum for tubing for supplying water under pressure, means for drivingly rotating the winding drum, two rotary arms, one on each side of the carriage, provided with nozzles supplied with water under pressure, a rotary arm carried at the front of the carriage and provided with nozzles supplied with water under pressure, two transverse arms extending laterally of the carriage in a direction perpendicular to the direction of advance and provided with nozzles supplied with water under pressure, the said transverse arms being angularly orientable about their axes, and drive means for angularly orientating these tranverse arms.

Figure 1:
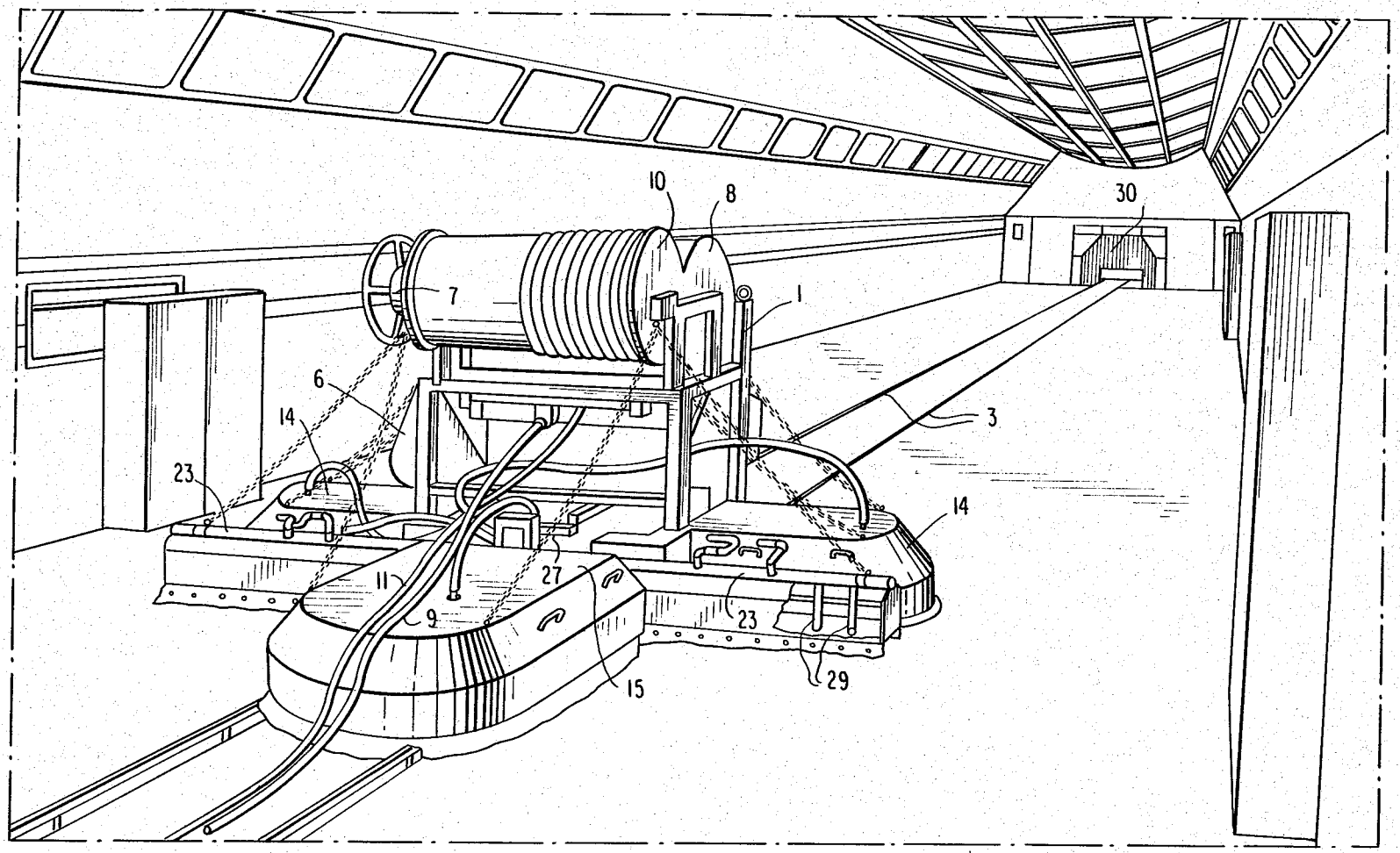
Figure 2:
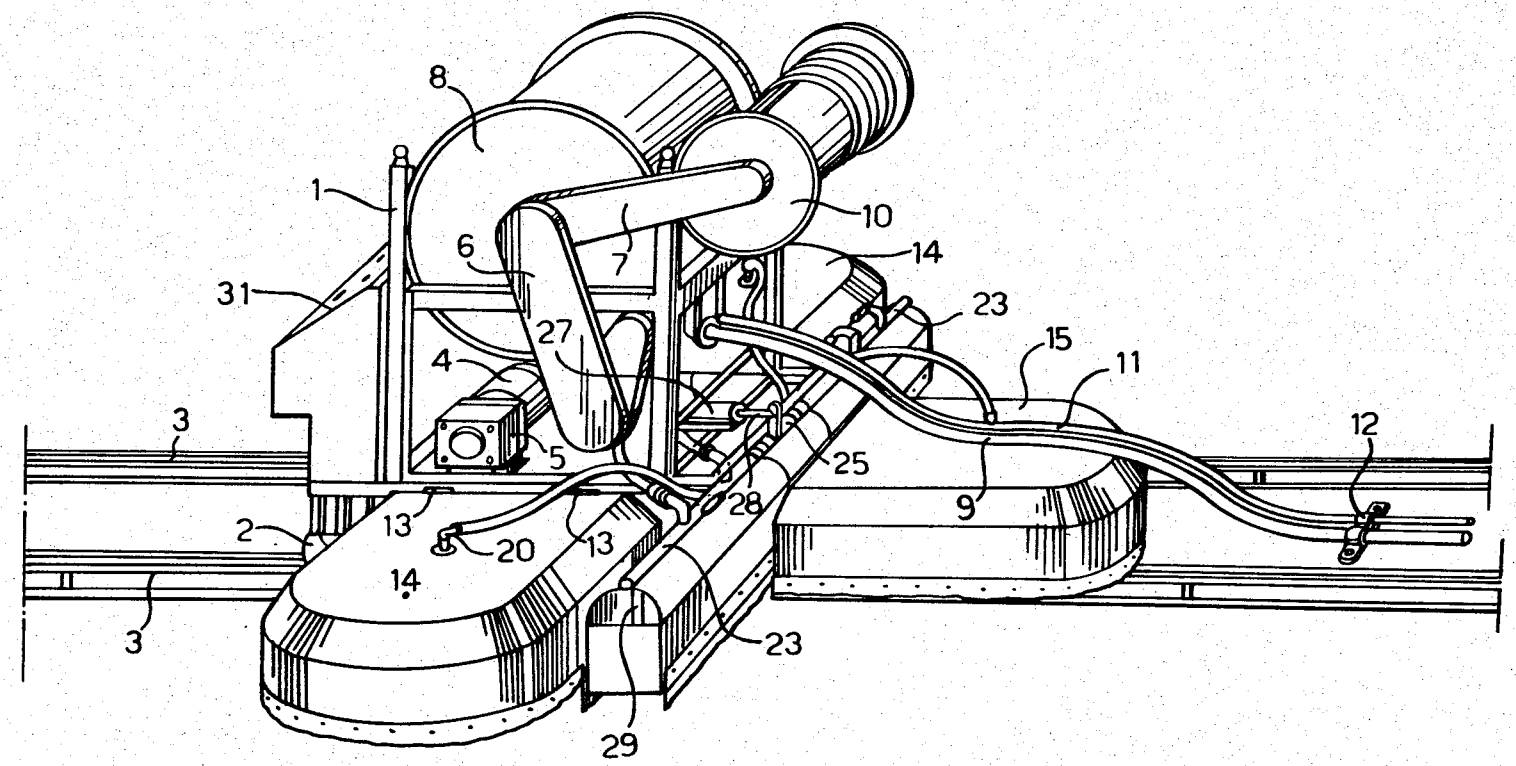
Figure 3:
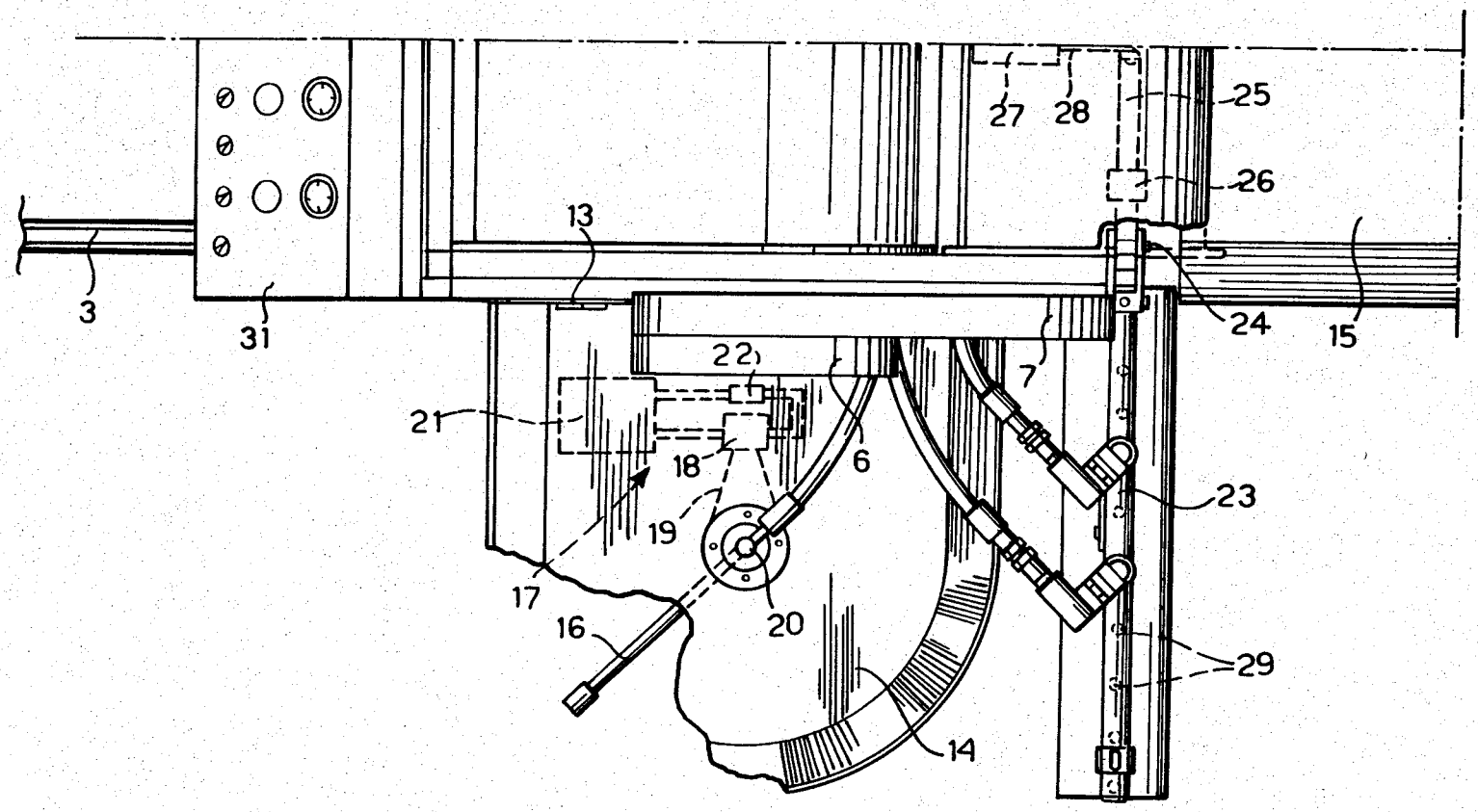

Further characteristics and advantages of the invention will become clearer from the description which follows with reference to the appended drawings, provided purely by way of non-limiting example, in which:

FIG. 1 is a perspective view of a painting chamber provided with apparatus according to the present invention, FIG. 2 is a perspective view of the apparatus, and FIG. 3 is a partial plan view of the apparatus illustrated in FIG. 2.

By 1 is indicated the chassis of a carriage provided with wheels 2 running on guide rails 3 which extend centrally along the longitudinal axis of a painting chamber.

The carriage 1 carries a pneumatic motor 4 which transmits drive to the wheels 2 through a gearbox 5 and chain transmission (not illustrated).

Drive is also transmitted, through flexible transmissions housed within protective casings 6, 7 to a drum 8 on which is wound a tube 9 for supplying water under pressure and to a drum 10 on which is wound a tube 11 for supplying compressed air.

The tubes 9 and 11 are fixed by means of a bracket 12 to the flooring of the painting chamber.

Two cowls 14 are hinged by means of hinges 13 (FIG. 3) on the two sides of the carriage 1.

A third cowl 15 is carried at the front of the carriage.

Within the two cowls 14 and the front cowl 15 are rotatably supported three nozzle-carrying arms 16 each provided with two end nozzles.

The arms 16 are rotated by the effect of the reaction of the pressurised water jet which is emitted from the two symmetrically disposed nozzles.

The pressure at which the water is supplied is of the order of 400 kg/cm$^2$.

The rate of rotation of the arms 16 is controlled by means of an oleodynamic regulator generally indicated 17. This regulator includes an oleodynamic pump 18 connected through a chain transmission 19 to the shaft 20 of the arm 16.

The pump 18 circulates oil in a closed circuit including a reservoir 21 and a micrometer cock 22 which allows the throttling of the oil passage.

The carriage 1 carries at its front two nozzle-carrying arms 23 extending on the two sides of the carriage in directions perpendicular to the direction of advance.

Each of the arms 23 is hinged about a longitudinal axis 24 to a support bar 25 rotatably mounted about its own axis on supports 26.

By 27 is indicated a pneumatic cylinder the rod 28 of which is arranged to cause angular displacement of the bar 25 and of the two nozzle-carrying bars 23 connected thereto to vary the orientation of the nozzles 29 carried by the bars 23.

The carriage also carries a reservoir (not illustrated) which allows the supply of a protective product to the nozzle-carrying bars 23 for protecting the grating of the painting chamber after the hydrodynamic cleaning phase.

The said reservoir is connected to the two nozzle-carrying bars 23 through a servo-controlled distributor in alternation with the supply of water under pressure to the said nozzle-carrying bars 23.

The nozzle-carrying bars 23 have the function of effecting the cleaning of the bottom of the tank which is underneath the gratings.

The fact that the cowls 14 and the nozzle-carrying bars 23 are hinged about longitudinal axes enables the apparatus to be reduced in bulk to allow it to pass through the entry bulkhead 30 of the painting chamber.

The carriage also carries a control panel 31 which controls the automatic distribution of water at high pressure to the various nozzles in a predetermined sequence.

In use of the apparatus described above the carriage is first moved into the painting chamber and cleans the central strip of the chamber itself by means of the rotary arm housed in the front cowl 15.

Then with a further two passes, the two lateral bands of the flooring of the chamber are cleaned by means of the rotary arms 16 housed in the two side cowls 14.

In the final, return phase of the carriage, the nozzle-carrying bars 23 are brought into action and effect the cleaning of the bottom of the tank.

The distributor is then actuated and with a further passage of the carriage the bars 23 distribute the protective product for the grating.

Blocks are provided at the ends of the track to operate sensors for the purpose of completing the working sequence completely automatically.

Since the number of rotating nozzles is limited (two or at most four when the two side rotors 16 are operated simultaneously) the pump unit may be of relatively low power.

Indeed the trajectories described for the nozzles are rigorously controlled and the energy available is distributed uniformly with a continuous and progressive action. As a result, the entire surface of the grating may be cleaned in a relatively short time and uniformly, considerably reducing the cleaning costs relative to the previous methods.

The apparatus which is the subject of the invention may be used for cleaning flooring surfaces in general and airport runways, as well as for cleaning painting chambers.

I claim:

1. Apparatus for cleaning a horizontal surfaces by hydrodynamic action, comprising:

a motorised carriage which can be moved back and forth over a said horizontal surface to be cleaned, a hose having one end connectable to a supply of water under pressure, a winding drum for said hose, the drum being mounted on said carriage, first drive means for drivingly rotating the winding drum to pay out and wind in said hose, two lateral rotary arms rotatably carried by said carriage on respective sides thereof for rotation about vertically disposed axes, said lateral arms being provided with downwardly directed nozzles arranged to be supplied with water under pressure from said hose, a front rotary arm carried at the front of the carriage for rotation about a vertically disposed axis and provided with downwardly directed nozzles arranged to be supplied with water under pressure from said hose, two transverse arms extending transversely of the carriage in a direction perpendicular to the direction of movement thereof, said transverse arms being provided with downwardly directed nozzles arranged to be supplied with water under pressure from said hose and the transverse arms being angularly orientatable about their longitudinal axes, and second drive means for angularly orienting the said transverse arms.

2. Apparatus according to claim 1, wherein said motorised carriage incudes a pneumatic motor for effecting back and forth movement of a carriage, said apparatus further comprising a further winding drum mounted on the carriage, compressed air tubing wound on said further drum, and third drive means for drivingly rotating said further drum to pay out and wind in said tubing, the said first, second and third drive means being pneumatic drive means and said drive means and motor being arranged to be supplied with compressed air via said tubing.

3. Apparatus according to claim 1, wherein said hose for supplying water under pressure and said compressed-air tubing are fixable to the said surface to be cleaned and are arranged to be deposited and rewound by the two drums during the back and forth movement of the carriage.

4. Apparatus according to claim 1, wherein an oleodynamic device is provided for regulating the rate of rotation of said rotary arms.

5. Apparatus according to claim 1, wherein said carriage is provided with a central control unit including servo-valves connected between said hose and said nozzles and arranged to distribute water automatically to the nozzles in a predetermined sequence.

6. Apparatus according to claim 1, wherein said carriage is provided with a reservoir for containing a protective product, and means for selectively feeding said product from the reservoir to the two said transverse arms.

* * * * *